US006253860B1

(12) United States Patent
Pöysti et al.

(10) Patent No.: US 6,253,860 B1
(45) **Date of Patent: *Jul. 3, 2001**

(54) METHOD AND ARRANGEMENT FOR CONTROLLING ROCK DRILLING

(75) Inventors: Tapani Pöysti; Tapani Huhdanmäki, both of Tampere (FI)

(73) Assignee: Sandvik Tamrock Oy, Tampere (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/202,023

(22) PCT Filed: Jun. 23, 1997

(86) PCT No.: PCT/FI97/00400

§ 371 Date: Dec. 8, 1998

§ 102(e) Date: Dec. 8, 1998

(87) PCT Pub. No.: WO97/49896

PCT Pub. Date: Dec. 31, 1997

(30) Foreign Application Priority Data

Jun. 25, 1996 (FI) ..... 962623
Dec. 12, 1996 (FI) ..... 964990

(51) Int. Cl.[7] ..... B23Q 5/20; E21C 5/16

(52) U.S. Cl. ..... 173/1; 173/2; 173/4; 173/11; 175/27

(58) Field of Search ..... 173/1, 2, 4–9, 173/11; 175/27

(56) References Cited

U.S. PATENT DOCUMENTS 3,550,697 * 12/1970 Hobhouse ..... 173/8
3,659,655 * 5/1972 Gyongyosi ..... 173/1
3,872,932 * 3/1975 Gosselin ..... 173/1
4,165,789 * 8/1979 Rogers ..... 173/8
4,356,871 11/1982 Fujikawa .
5,168,937 * 12/1992 Hamner ..... 173/4
5,348,106 * 9/1994 Mattero ..... 173/1
5,449,047 * 9/1995 Schivley, Jr. ..... 173/11
5,458,207 * 10/1995 Mattero ..... 173/6

OTHER PUBLICATIONS

WPI/Derwent's abstract, No82–99288E, week 8246, Abstract of SU, 898048 (Ivano–Frank Oil Gas), Jan. 15, 1982.

* cited by examiner

*Primary Examiner*—Scott A. Smith
(74) *Attorney, Agent, or Firm*—Nixon & Vanderhye P.C.

(57) ABSTRACT

A method and an arrangement for controlling rock drilling on the basis of a pressure acting in a pressure conduit of a rotation motor of a drill rod. In the method, the pressure acting in the pressure fluid conduit of the rotation motor is measured during the rotation when the drill bit does not touch the rock to be drilled, and the control is carried out thereafter on the basis of the difference between the pressure value measured during the drilling and the idle pressure value. In the arrangement, the rock drilling machine comprises a control unit that measures the pressure acting in the pressure fluid conduit of the rotation motor when the drill rod is rotated so that it does not touch the rock to be drilled and stores it in the memory and controls the rock drilling machine during the drilling on the basis of the difference between the pressure value measured during the drilling and the idle pressure.

12 Claims, 2 Drawing Sheets

METHOD AND ARRANGEMENT FOR CONTROLLING ROCK DRILLING

The invention relates to a method for controlling a rock drilling machine, wherein the drilling is controlled on the basis of a pressure that acts in a pressure conduit of a hydraulically operated rotation motor and that is proportional to the rotation resistance of a drill rod.

The invention further relates to an arrangement for controlling a rock drilling machine, the arrangement comprising means for measuring the pressure acting in a pressure conduit of a hydraulically operated rotation motor and for controlling the operation of the rock drilling machine on the basis of the measured pressure.

When drilling holes with a rock drilling machine, different so-called automated fissure-drilling methods and methods for adjusting the moment of the drilling utilize the pressure acting on the rotation motor of the drill rod. This is based on the idea that the pressure value is proportional to the rotation resistance acting on the drill rod during the drilling and the adjustment can therefore be carried out on the basis of this pressure value. In such methods, for example the rate and direction of the feeding are adjusted on the basis of the pressure value. When adjusting the feeding, the feed force is decreased as the pressure value representing the rotation resistance increases, and correspondingly, the feed force can be increased when the pressure value decreases. Correspondingly, if the rotation resistance increases to a certain level, the feeding is switched to a return motion on the basis of the pressure, so that the drill bit would not get stuck in broken rock or the like.

The adjusting methods implemented in the known manner are problematic in that the changes of pressure resulting from losses occurring in the apparatus itself and from alterations in the viscosity of the pressure fluid cannot be taken into account in any way in the prior arrangements. Also, when the drilling starts and the apparatus is cold, due to the temperature of the pressure fluid the viscosity is different than in an apparatus having a normal temperature, which slows down the drilling inconveniently or causes unnecessary return movements. Further, in long hole drilling as the number of the drill rods increases, the rotation resistance to the drill rod increases and therefore the drilling requires a greater rotation force. The prior arrangements do not take into account this matter either, which results in the occurrence of the above-described problems also during long hole drilling.

The purpose of the present invention is to provide a method and an arrangement which avoid the drawbacks of the prior methods and which provide more accurate and reliable operation of the apparatus. The method according to the invention is characterized in that before the actual drilling, the value of the idle pressure acting in the pressure conduit of the rotation motor is measured when the drill rod is rotated, said value being used as the reference value to control the actual drilling, and that the control value used to control the drilling is the difference between the pressure acting in the pressure conduit of the rotation motor measured during the drilling and said idle pressure.

The arrangement according to the invention is characterized in that it comprises a control unit which measures the value of the actual idle pressure acting in the pressure fluid conduit of the rotation motor when the drill rod is rotated before the actual drilling, and which stores the measured idle pressure value in the memory and measures during the drilling the pressure value acting in the pressure fluid conduit of the rotation motor and controls the rock drilling machine on the basis of the difference between the pressure value measured during the drilling and the idle pressure value stored in the memory.

The basic idea of the invention is that before the actual drilling, the pressure acting on the rotation motor is measured and this measured so-called idle pressure is used as the zero level or reference value during the use of an adjustment method based on the pressure acting on the rotation motor. In such a case, the pressure value on which the actual adjustment is based is the difference between the idle pressure and the pressure measured during the adjustment. This measurement can be carried out both at the beginning of the drilling before the drill bit touches the rock and, correspondingly in long hole drilling, before the feeding and percussion are set to the values according to normal drilling.

The invention has the advantage that the measurement of the idle pressure value carried out at the beginning of the drilling provides at all times a reliable zero level which is proportional to the mode of operation of the apparatus and to which the measurement of the pressure value of the actual drilling method can be compared in a reliable manner. in such a case, both the differences resulting from the temperature of the pressure fluid and the viscosity values, and the other losses occurring in the apparatus are taken into account, and therefore the adjustment can be carried out in a reliable and accurate manner. Also, common malfunctions can be avoided with the method according to the invention. The invention also has the advantage that in long hole drilling the zero level can be the pressure value that acts on the rotation motor and that is produced by the friction between the extension rod and the wall of the drill hole, and the mass of the extension rod, and the normal drilling adjustment is thus based on the difference between the aforementioned pressure value of idle rotation and the actual pressure value. The invention also makes it possible to control better not only normal drilling but special situations occurring in drilling. Such special situations include, for example, through drilling that has previously resulted in a sudden forward movement of the rock drill. In the arrangement and method according to the invention, through drilling is detected immediately when the difference between the aforementioned pressure value of idle rotation and the pressure value of the actual rotation comes rapidly close to zero, whereupon the drilling adjustment reacts in a predetermined manner.

The invention will be described in greater detail in the accompanying drawings.

FIG. 1 shows schematically a hydraulic diagram for implementing a method according to the invention, and FIG. 2 shows schematically, by way of example, the effect of the viscosity of the pressure fluid on the pressure values acting over the rotation motor.

FIG. 1 shows schematically a hydraulic diagram of a rock drilling machine. The figure shows a motor 1 that rotates pressure fluid pumps 2 and 3. The pressure fluid flows from the pressure fluid pump 2 via a conduit 4 to a control valve 5 and from there to a rotation motor 6. A control pressure conduit 7 leads from the pressure conduit of the rotation motor 6 back to the pump 2, which is a pressure-controlled volume flow pump. The rate of rotation thus remains constant regardless of the pressure when the pump feeds a certain volume flow of the pressure fluid through the rotation motor 6. The pressure fluid flows from the pressure fluid pump 3, which is also a pressure-controlled volume flow pump, via a conduit 8 to a percussion device 9 and further via a second control valve 10 to a feed motor or feed cylinder 11. A control pressure conduit 12 leads from the pressure fluid conduits of the feed cylinder 11 via a shuttle valve 13 to the control pressure conduit of the pump 3. Correspondingly, a second control pressure conduit 14 leads from the pressure fluid conduit 8 to the shuttle valve 13 and is connected through it to the control pressure conduit of the pump 3, whereupon the conduit 12 or 14 having a higher pressure is connected to control the volume flow pump.

A pressure indicator 15 is connected to the feed conduit of the rotation motor 6 to indicate the pressure acting in the inlet conduit of the rotation motor 6 in the direction of supply. The pressure indicator 15 is connected via a signal channel 16 to a control unit 17. The control unit 17 is further connected via control signal channels 18 to 21 to guide the valves 5 and 10 of the apparatus and the operation of pressure relief valves 22 and 23 restricting the pressure in the control pressure conduit of the pump 3. Measurement and control data can be conducted from the control unit 17 to a separate diagnostic apparatus with which it is possible, for example, to control the condition of the rotation system on the basis of the normal values, as regards the pump, valves, rotation mechanism etc. Since the diagnostic apparatus is not included within the scope of the invention per se, it will not be described in greater detail herein. Further, it is possible to set in the control unit control values which guide the operation of the apparatus.

BRIEF DESCRIPTION OF THE DRAWINGS

According to the method, when the drilling of a hole is started, the pressure indicator 15 indicates the pressure value, i.e. the idle pressure, acting in the pressure conduit of the rotation motor before the drill bit touches the rock. This actual measured idle pressure value is stored in the memory of the control unit to indicate the operative pressure during the idle motion, and the pressure value measured later during the drilling is compared to it. During the drilling, the pressure level in the pressure conduit of the rotation motor is indicated continuously by means of the pressure indicator 15 and the control unit adjusts the drilling, if required, according to the difference between the pressure value measured and the idle pressure. For example when the pressure increases in the pressure conduit of the rotation motor 6, the control unit 17 adjusts the feeding by guiding the valve 22 such that as the pressure increases the feeding slows down, and when the pressure starts to drop the feeding is correspondingly expedited. Further, if the pressure value exceeds a predetermined pressure limit, in other words if the difference between the pressure prevailing in the pressure conduit of the rotation motor and the free rotation pressure indicating the reference level measured at the beginning exceeds the set pressure difference value, the control unit 17 may guide the valve 10 and invert the direction of feeding.

Correspondingly, during long hole drilling the pressure indicator 15 also indicates the idle pressure caused by the friction between the drill rod and the drill hole when the actual drilling has not been started. Therefore, whenever a new extension rod has been added or in some cases before a new drill rod is added, it is possible to set a corresponding pressure value in the memory of the control unit to indicate the current rotation resistance, and the adjustment is thus always carried out on the basis of the latest measured pressure value of idle rotation. In this case, the pressure value that was stored last is used as the set value for idle pressure, and the control unit adjusts the drilling on the basis of the difference between the pressure value measured when the drilling is continued and the aforementioned value stored last. In such a case, the control can be adjusted for example in the manners disclosed above in connection with starting the drilling. Correspondingly, when the drill rod is dismantled the idle pressure can be measured whenever the previous drill rod has been removed, whereupon it is correspondingly possible to control the operations and feeding of the rock drill according to the pressure difference during the dismantling of the drill rod when the rotation resistance increases too much.

Correspondingly, the difference between the pressure measured in this way and the idle pressure can be used to control other drilling operations, such as rotation and percussion. The different drilling parameters can then be adjusted suitably with respect to each other to provide the desired drilling result.

Figure 1:
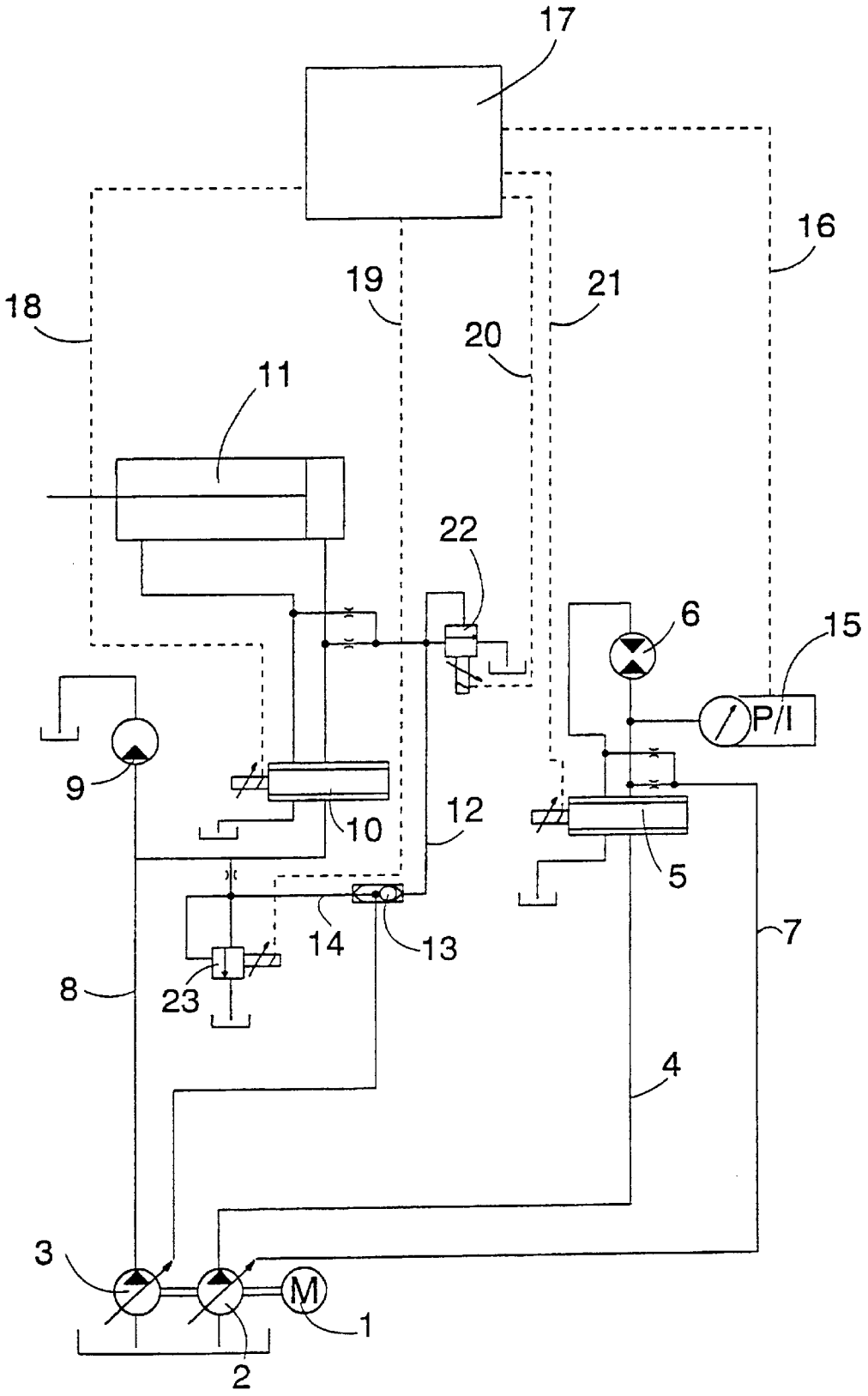
Figure 2:
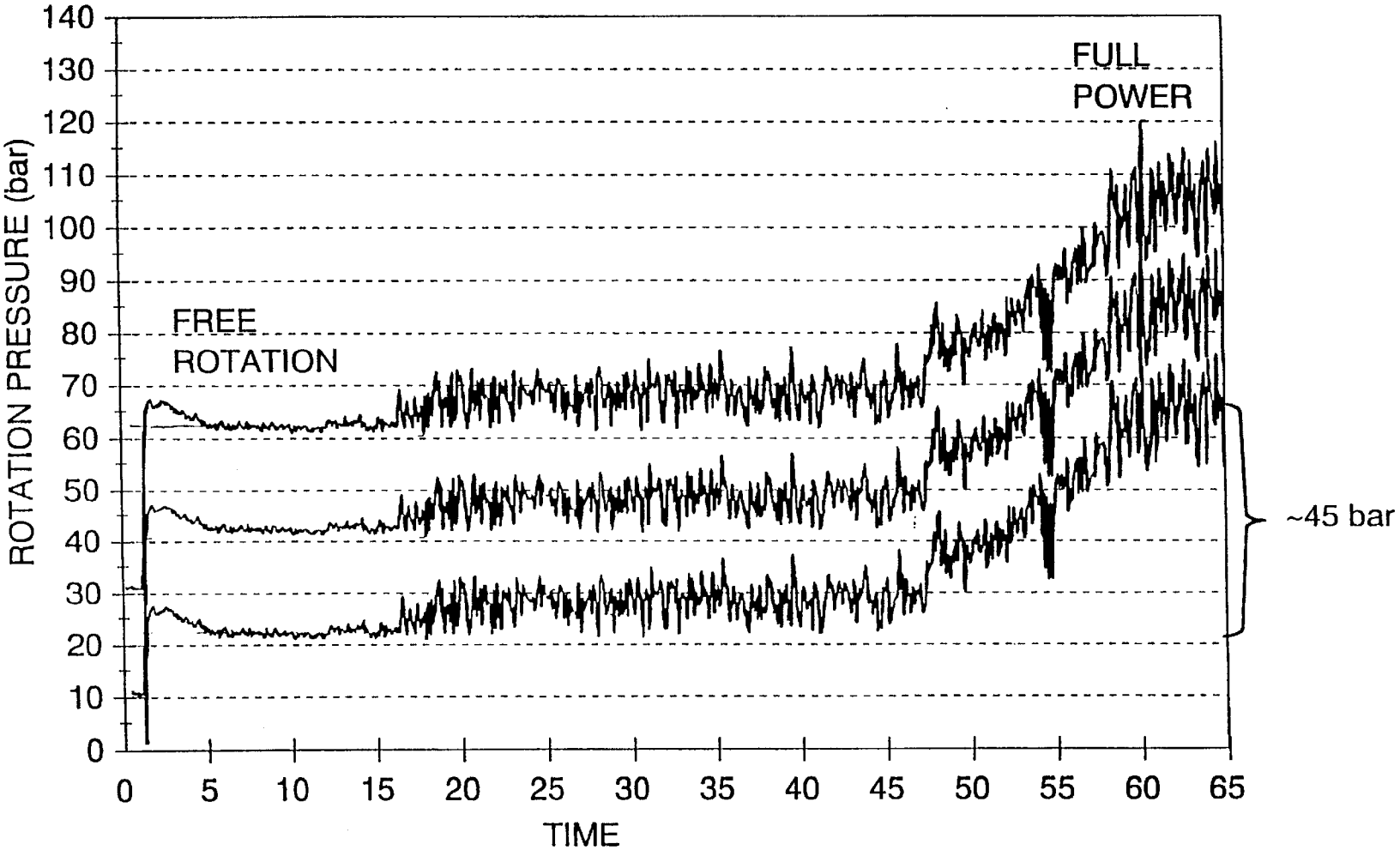

FIG. 2 in turn shows schematically how the viscosity of the pressure fluid, for example, affects the pressure values measured during free rotation and operation. The figure shows schematically pressure values measured at different values of viscosity both during free rotation and at different stages of drilling. As the figure shows, during the free rotation before the drill bit touches the rock, the value of idle pressure may be, for example, about 22 to 62 bar measured with a certain kind of rock drilling machine. When the average value of the rotation pressure during normal drilling is about 45 bar higher than the pressure value obtained during free or idle rotation, in another situation the pressure value of free rotation is even higher than the difference between the pressure values of free rotation and full power. When the average pressure value of free rotation is used according to the invention as the reference level and only the pressure difference is used to control the drilling, the control and adjustment can be made far more accurate and reliable. When the pressure difference is used, the drilling operation of the apparatus is only dependent on the changes caused by the operation since the effect of the idle pressure brought about by the operation of the apparatus is counteracted by setting this pressure as the reference pressure or zero level when changes in pressure are measured.

The invention is described above in the specification and in the drawings by way of example only, and it is in no way restricted thereto. The control connections and adjustments guiding the operation may be implemented in several manners known per se, as long as the pressure value resulting from the idle motion of the apparatus, i.e. the mere rotation of the drill rod, is measured first according to the method either when the drilling is started in case of the rotation of one drill rod, or when a new extension rod is added, preferably after its addition, in case of long hole drilling, and the pressure in the pressure conduit of the rotation motor is thereafter measured by using the difference between the pressure value measured during the idle motion and the idle pressure value measured during the drilling for the control and adjustment.

What is claimed is:

1. A method for controlling a rock drilling machine in a drilling operation, wherein drilling is controlled on the basis of a pressure that acts in a pressure conduit of a hydraulically operated rotation motor and that is proportional to rotation resistance of a drill rod, the method comprising: (a) in the drilling operation, but before actual drilling commences, measuring actual idle pressure acting in the pressure conduit of the rotation motor when the drill rod is rotated; (b) using said actual idle pressure as a reference value to control said actual drilling; and (c) using a control value to control said actual drilling, said control value being a difference between pressure acting in the pressure conduit of the rotation motor measured during said actual drilling and said actual idle pressure.

2. A method according to claim 1, wherein said actual idle pressure is measured in step (a) substantially immediately before said actual drilling of a hole and stored in a control unit memory, and further wherein said actual drilling is controlled as a function of the difference between the pressure measured during drilling of said hole and said actual idle pressure stored in said memory before said actual drilling of said hole.

3. The method of claim 2 wherein the drilling operation includes drilling of a plurality of holes and wherein said actual idle pressure is measured in step (a) substantially before said actual drilling of each hole in the drilling operation.

4. A method according to claim 1, wherein said idle pressure is measured before a drill bit of the rock drilling machine touches rock to be drilled.

5. A method according to claim 1, wherein during long hole drilling, said idle pressure is measured when interconnected drill rods are rotated in a hole already partially drilled.

6. A method according to claim 5, wherein said actual idle pressure is measured after addition of a new drill rod but before said actual drilling is continued.

7. The method of claim 1 wherein the drilling operation includes drilling of a plurality of holes and wherein step (a) is carried out for each hole in the drilling operation.

8. An arrangement for controlling a rock drilling machine in a drilling operation, the arrangement comprising means for measuring actual idle pressure acting in a pressure conduit of a hydraulically operated rotation motor and for controlling operation of the rock drilling machine as a function of said actual idle pressure, said arrangement comprising a control unit including means for (a) measuring said actual idle pressure acting in the pressure fluid conduit of the rotation motor when a drill rod is rotated in the drilling operation but before actual drilling; (b) storing the measured actual idle pressure in a memory of the control unit; (c) measuring, during drilling, pressure acting in the pressure fluid conduit of the rotation motor; and (d) controlling the rock drilling machine as the function of a difference between the pressure measured during actual drilling and said actual idle pressure stored in said memory of said control unit.

9. An arrangement according to claim 8, wherein said control unit is arranged to measure said idle pressure before actual drilling of a hole is started; and wherein said control unit stores said idle pressure in said memory and controls the rock drilling machine as a function of a difference between the pressure measured during actual drilling of said hole and the idle pressure value stored in said memory immediately before the actual drilling of said hole.

10. An arrangement according to claim 8, wherein, during long hole drilling, said control unit is arranged to measure said idle pressure when drill rods of said rock drilling machine are rotated in a hole already drilled before the actual drilling is continued.

11. An arrangement according to claim 10, wherein said control unit is arranged to measure said actual idle pressure value whenever a new drill rod has been added to a previous drill rod.

12. The arrangement of claim 8 wherein the drilling operation includes drilling of a plurality of holes and wherein the control unit performs functions (a), (b), (c) and (d) for each hole in the drilling operation.

* * * * *